US006093072A

United States Patent [19]

Dynka et al.

[11] Patent Number: 6,093,072

[45] Date of Patent: Jul. 25, 2000

[54] LOADING PROCESS TO PROVIDE IMPROVED VACUUM ENVIRONMENT

[75] Inventors: Dan Dynka, Meridian; David A. Cathey, Boise, both of Id.

[73] Assignee: Micron Technology, Inc., Boise, Id.

[21] Appl. No.: 09/084,673

[22] Filed: May 26, 1998

[51] Int. Cl.[7] ..... H01J 9/385; H01J 9/39

[52] U.S. Cl. ..... 445/40; 445/42

[58] Field of Search ..... 445/40, 42, 41

[56] References Cited

U.S. PATENT DOCUMENTS

| | | | |
|---|---|---|---|
| 3,658,401 | 4/1972 | Files | 445/42 |
| 4,018,490 | 4/1977 | Berkenblit et al. | 445/42 |
| 5,564,958 | 10/1996 | Itoh et al. | 445/42 |
| 5,688,708 | 11/1997 | Kato et al. | 445/41 |

OTHER PUBLICATIONS

Giorgi, T.A., "Getters and Gettering", Proc. 6th Internl. Vacuum Congr. 1974; Japan, J. Appl. Phys. Suppl. 2, Pt. 1, 1974, pp. 53–60.

saes getters, "Barium Getters for Lamps, Special Tubes, Receiving Tubes".

saes getters, "St121 and St122 Porous Coating Getters", Jul. 1987, pp. 2–8 (text) plus tables.

saes getters, "St171® Non–Evaporable Porous Getters", Oct. 1989, p. 5.

*Primary Examiner*—Kenneth J. Ramsey
*Attorney, Agent, or Firm*—Hale and Dorr LLP

[57] ABSTRACT

A pump is used to reduce the pressure in a field emission display package. The package is then filled with a gas or gas mixture, such as nitrogen and hydrogen. The package is then pumped again, to reduce the pressure in the package to the desired pressure and to obtain the desired partial pressure of the gas. Optionally, the process is then repeated, with a gas or gas mixture again inserted into the package and then the pressure reduced with a pump. After pumping, the package may be heated to cause outgassing and to activate a getter. The pumping is performed with a mechanical pump, an ion pump, or a combination of the two types of pumps.

18 Claims, 3 Drawing Sheets

LOADING PROCESS TO PROVIDE IMPROVED VACUUM ENVIRONMENT

BACKGROUND OF THE INVENTION

The present invention relates to the field of electronic displays and, in particular, to packages for field emission display ("FED") devices.

As the technology for producing small, portable electronic devices progresses, there is an increasing need for electronic displays that are small, provide good resolution, and consume small amounts of power. Low power consumption is important in order to provide extended battery operation.

Existing displays are generally constructed based upon cathode ray tube ("CRT") or liquid crystal display ("LCD") technology. However, neither of these technologies is ideally suited to the demands of small, portable electronic devices.

CRT's have excellent display characteristics, such as color, brightness, contrast, and resolution. However, they are also large, bulky, and consume power at rates that are incompatible with extended battery operation in portable computers.

LCD displays consume relatively little power and are small in size. However, by comparison with CRT technology, LCD displays provide poor contrast and permit a relatively limited range of viewing angles. Color versions of LCD's, like CRT's, tend to consume power at a rate that is incompatible with extended battery operation.

As a result of the deficiencies of CRT and LCD technology, efforts are underway to develop new types of electronic displays for electronic devices. One technology currently being developed involves the use of field emission displays ("FED"). FED's include large numbers of emitters formed on a baseplate. The emitters emit electrons, which strike a phosphor pattern (for example, dots) or monochrome layer on a faceplate, to produce the display.

FED's require a vacuum between the baseplate and the faceplate, in order to provide a dear path for the electrons travelling from the emitters to the phosphor. Ideally, the pressure between the baseplate and the faceplate is on the order of $10^{-12}$ Torr, or a "perfect" vacuum.

However, field emission displays typically only obtain vacuums on the order of $10^{-5}$ to $10^{-6}$ Torr, due to limitations in the conductance paths and pumps used to evacuate molecules in the space between the baseplate and the faceplate without external cycle times. For example, in a typical evacuation process, a mechanical pump is used to evacuate the display from atmosphere to a pressure on the order of $10^{-3}$ Torr. Then, a turbo-pump is used to decrease the pressure into the range of $10^{-5}$ Torr, and an ion pump is used to complete the process. However, some of the molecules in the display are inert, or electrically inactive, with low molecular weight, and do not pump easily. As a result, these particles are not removed by the turbo pump or the ion pump, and consequently are not removed from the package, creating higher partial pressure. Also, some molecules, such as water, tend to bind to the interior structure and components of the display, further contributing to higher partial pressure. These molecules typically are not removed completely in existing processes.

Therefore, there is a need for a process that will more completely evacuate a field emission display or similar package.

SUMMARY OF THE INVENTION

In accordance with the present invention, a pump or combination of pumps is used to reduce the pressure in a field emission display or similar sealed package to approximately $10^{-5}$ to $10^{-7}$ Torr. An inlet is then used to fill the package with an electrically active gas or gas mixture, such as nitrogen and hydrogen, so that the pressure in the package is on the order of 1 to 100 Torr.

The package is then pumped again, to reduce the pressure in the package to a desired pressure and to obtain the desired partial pressure of the gas. Preferably, the process is then repeated, with a gas or gas mixture again injected into the package and then the pressure reduced with a pump. In one aspect of the present invention, the package is then heated. Heating will cause outgassing or displacement of molecules to occur. Though efficient in removing water, this may not displace hard-to-pump molecules.

Preferably, these steps are accomplished by attaching the package to a vacuum pumping system or placing the package in a vacuum chamber attached to a vacuum pumping system. The vacuum pumping system or vacuum chamber includes a port for inserting the gas from a gas delivery system.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
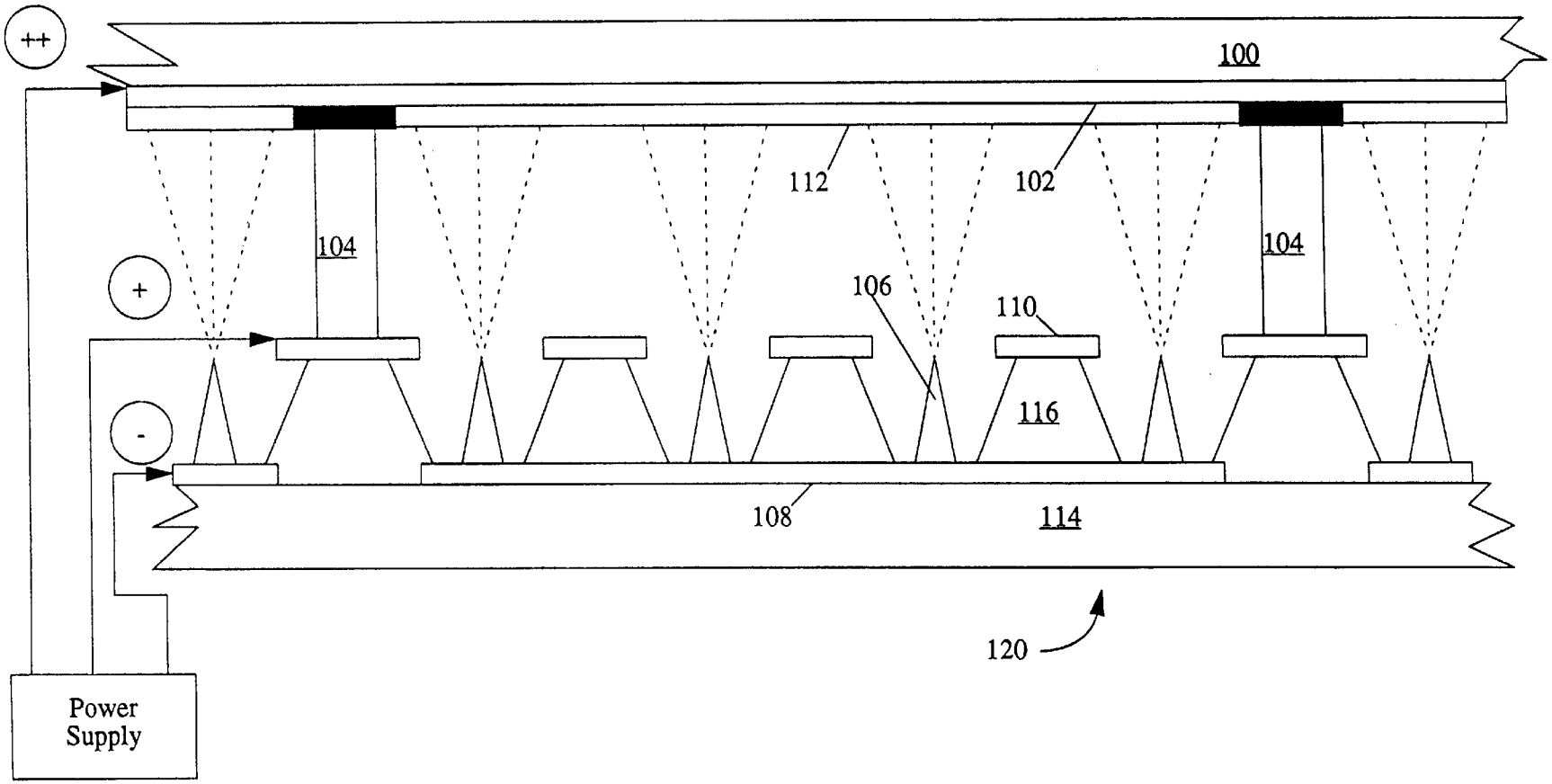
FIG. 1 is a cross-sectional view of a field emission display.

As shown in FIG. 1, a field emission display 120 includes a faceplate 100 on which is formed a transparent conductor 102. A phosphor pattern 112, such as dots or a monochrome layer, are formed on transparent conductor 102. Faceplate 100 is separated from non-conductive baseplate 114 by spacers 104. Although only two spacers 104 are shown, it is understood that a complete field emission display device would typically have a series of spacers 104. Spacers 104 prevent baseplate 114 from being pushed into contact with faceplate 100 by atmospheric pressure when the space between baseplate 114 and faceplate 100 is evacuated.

A plurality of emitters 106 are formed on baseplate 114. Preferably, emitters 106 are constructed by processes common in the semiconductor industry. A complete field emission display may have up to 1 million emitters 106 per square inch formed on baseplate 114, to provide a spatially uniform source of electrons.

Emitters 106 are separated by insulators 116. The firing of emitters 106 is controlled by row electrodes 108 and column electrodes 110.

Figure 2:
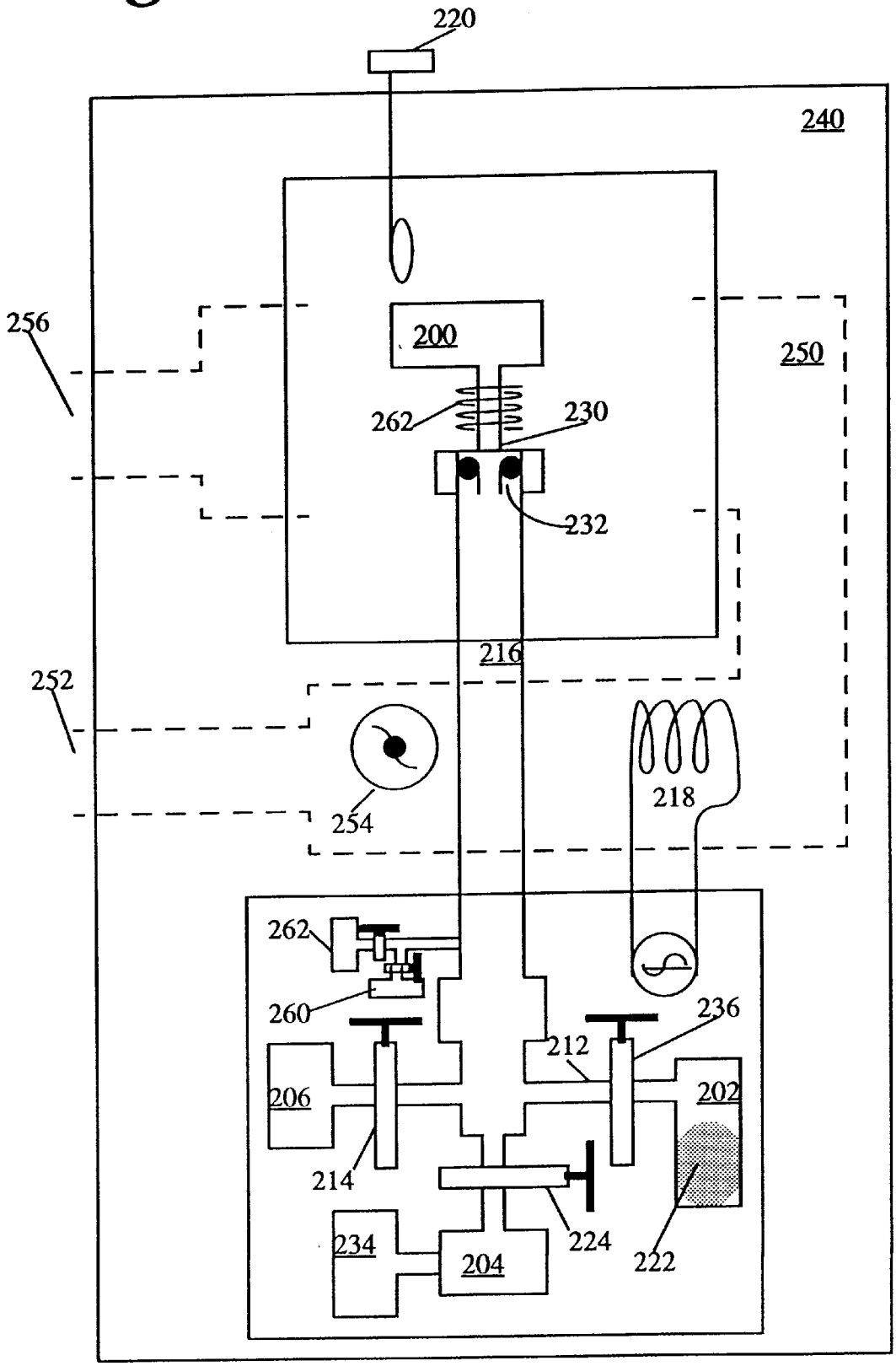
FIG. 2 is a schematic diagram of a first embodiment of a particle evacuation apparatus according to the present invention.

Referring to FIG. 2, an apparatus for evacuating a field emission display is shown. According to a first embodiment, FED 200 is a tubulated package with an inlet 230, and is placed in box oven 240. Typically, inlet 230 is surrounded by O-ring 232, which compresses to form a seal. Pump 204 is connected to inlet 230 of FED 200 via isolation valve 224 and vacuum path 216. Pump 204 is used to evacuate FED 200 to a first pressure, which is preferably on the order of $10^{-5}$ to $10^{-7}$ Torr.

Typically, pump 204 is a turbo-pump, such as the Alcatel 5400 Series Turbo Pump (supported by back pump 234), an Alcatel 100 or 31 Dry Pump, or another mechanical pump. These pumps can evacuate a large number of molecules more quickly than an ion pump. Alternatively, once the proper crossover pressure has been reached, ion pump 206, such as a Varian 30 or 100 liter Ion Pump, may be used to evacuate FED 200 to the first pressure. Ion pump 206 is connected to FED 200 via isolation valve 214 and vacuum path 216.

After evacuating the display to the first pressure, isolation valves 214 and 224 are dosed and gas source 202 is used to introduce gas 222 into inlet 230 through isolation valve 236, fill port 212, and vacuum path 216. Gas 222 fills FED 200. It is understood that gas 222 may be a single gas, such as nitrogen or hydrogen, or a combination of gasses, and that multiple gas sources can be connected to vacuum chamber 230 through fill port 212 or by other means. Gas source 202 injects gas 222 into FED 200 to a second pressure, which is preferably on the order of 1 to 100 Torr.

After filling FED 200 with gas 222 to the second pressure, isolation valve 236 is dosed, and isolation valve 224 is opened to connect pump 204 to vacuum chamber 230. Pump 204 reduces the pressure in FED 200 to a third pressure, which preferably is less than $10^{-7}$ Torr. Alternatively, pump 204 can be used to reduce the pressure in FED 200 and then isolation valves 214 and 224 can be switched to connect ion pump 206 to vacuum chamber 230 to reduce further the pressure in vacuum chamber 230. In general, as long as the pressure is below the crossover pressure, ion pump 206 can be used to reduce the pressure in vacuum chamber 230 to the third pressure.

The steps of filling FED 200 with a gas 222 and then reducing the pressure with pump 204 and/or ion pump 206 can be repeated as many times as appropriate to obtain the desired total pressure and/or partial pressure of gas 222 within FED 200. The pressure following each gas-filling sequence is typically in the same range. However, the pressure after each pumping sequence will be lower. This can be monitored with Residual Gas Analyzer 260 and ion gauge 262.

The molecules of gas 222 from gas source 202 may be used to dislocate undesirable molecules, such as water. For example, a molecule from gas 222, upon striking a water molecule adhered to the internal structure of FED 200, may overcome the adhesion due to the water molecule's hydrogen and oxygen bonds, and dislocate the water molecule. As a result, the water molecule is pumped out of FED 200 during the next pumping sequence.

Also, gas 222 may help break complex molecules within FED 200, such as methane, into simpler molecules. These simpler molecules are more easily pumped from FED 200.

When using ion pump 206, it is desirable to use an electrically active gas, such as nitrogen, for gas 222. The molecules of the electrically active gas are easily pumped from FED 200 using ion pump 206. By using an electrically active gas that has relative large molecules (as does nitrogen), the gas tends to dislocate smaller, inert molecules, such as argon. In a preferred embodiment, a mixture of hydrogen and nitrogen is used. For example, the mixture may consist of 7% hydrogen and 93% nitrogen.

Heater 218 is used to heat FED 200 during the process. According to another aspect of the present invention, heater 218 is used to further increase the temperature of FED 200 during and through the final evacuation step, in order to assist in the removal of undesirable molecules. Using the apparatus of FIG. 2, air plenum 250 provides a path for air from inlet 252, past blower fan 254 and heater 218, so that heated air is blown across FED package 200 before the heated air is removed through exhaust outlet 256.

Figure 3:
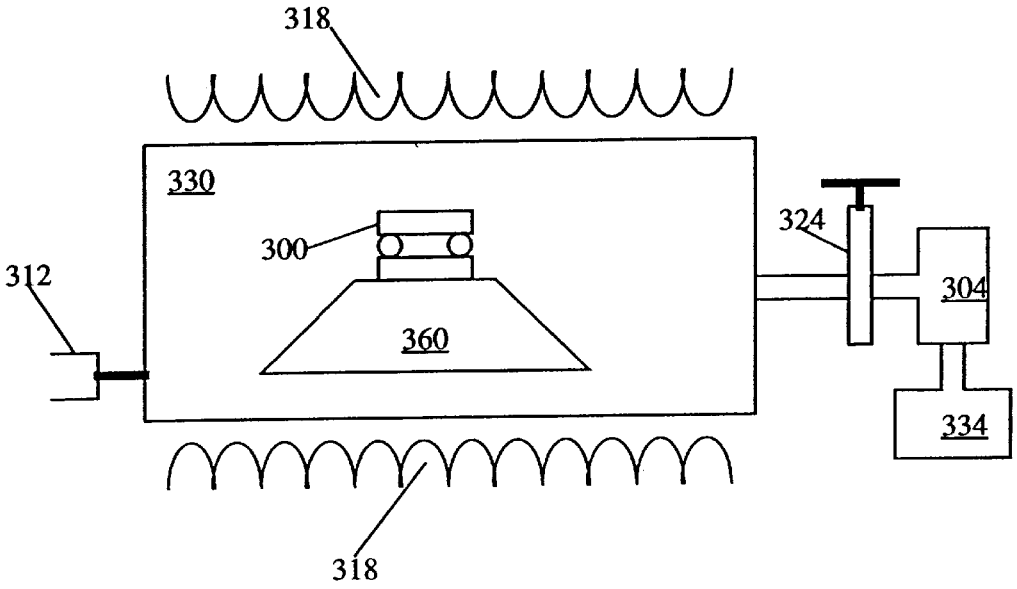
FIG. 3 is a schematic diagram of a second embodiment of a particle evaucation apparatus according to the present invention.

Alternatively, as shown in FIG. 3, FED 300 may be mounted on work holder 360 in vacuum chamber 330. In a preferred embodiment, vacuum chamber 330 is an appropriately connected diffusion tube, as is known in the art. As with the use of the box oven described with respect to FIG. 2, vacuum chamber 330 may be connected to a pump 304, such as a turbo pump, which in turn is connected to back pump 334. Pump 304 is connected to vacuum chamber 330 through isolation valve 324. Heating element 318 surrounds at least a portion of vacuum chamber 330, and is used to heat FED 300 during and after the final evacuation step. Although not shown, an ion pump can also be used in the apparatus of FIG. 3, and gas can be injected into vacuum chamber 330 through fill port 312, in a like manner as described above in connection with FIG. 2. The apparatus of FIG. 3 is particularly well suited for a non-tubulated FED.

Heating FED 200 makes the evacuation of gas molecules more efficient by dislocating the gas molecules from the FED structure. As a result, they are more easily pumped out of the display. Heating also will reduce the number of iterations of filling and pumping that are necessary to achieve the desired pressures within the FED.

Generally, FED 200 is heated to at least 150° C., a temperature at which water begins to break down. As a general rule, more outgassing occurs as the temperature is increased. The temperature is monitored with temperature gauge 220.

Preferably, FED 200 is heated to at least 200 to 225° C., and in a preferred embodiment FED 200 is heated to 300 to 500° C. Preferably, FED 200 is maintained at the heated temperature for at least 1 hour. After the package is heated, it is sealed.

To maintain the integrity of the vacuum, a getter is included within FED 200 and activated by heating. Preferably, the getter is heated using RF energy from RF energy source 266. Depending on the application, the getter can be heated before, during, or after the package is sealed.

While there have been shown and described examples of the present invention, it will be readily apparent to those skilled in the art that various changes and modifications may be made therein without departing from the scope of the invention as defined by the appended claims. Accordingly, the invention is limited only by the following claims and equivalents thereto.

We claim:

1. A method for manufacturing a field emission display comprising the steps of:

evacuating the display to a first pressure lower than approximately $10^{-5}$ Torr;

filling the display with a gas to a second pressure between approximately 1 and 100 Torr; and evacuating the display to a third pressure lower than the first pressure.

2. A method as in claim 1, wherein the step of evacuating the display to a third pressure includes evacuating the display to a pressure lower than approximately $10^{-7}$ Torr.

3. A method as in claim 1, wherein the step of filling the display with a gas includes filling the display with nitrogen.

4. A method as in claim 1, wherein the step of filling the display with a gas includes filling the display with a mixture of gasses.

5. A method as in claim 4, wherein the step of filling the display with a gas includes filling the display with a mixture of nitrogen and hydrogen.

6. A method as in claim 1, wherein the step of evacuating the display to a third pressure includes evacuating the display with a mechanical pump.

7. A method as in claim 1, wherein the step of evacuating the display to a third pressure includes evacuating the display with an ion pump.

8. A method as in claim 7, wherein the step of filling the display with a gas includes filling the display with an electrically active gas.

9. A method as in claim 1, wherein the step of evacuating the display to a third pressure includes evacuating the display with a mechanical pump and an ion pump.

10. A method for manufacturing a field emission display comprising the steps of:

evacuating the display to a first pressure; and obtaining a desired pressure within the display, the desired pressure being lower than the first pressure, by repeating at least once the steps of:

filling the display with a gas; and evacuating the display so as to reduce the pressure within the display;

wherein a repetition of the steps for obtaining the desired pressure within the display obtains a pressure lower than the pressure obtained in a previous iteration of the steps.

11. A method as in claim 10, wherein the obtaining a desired pressure step includes obtaining a desired total pressure within the display.

12. A method as in claim 10, wherein the obtaining a desired pressure step includes obtaining a desired partial pressure of the gas.

13. A method for manufacturing a sealed package comprising the steps of:

evacuating the package to a first pressure;

obtaining a desired pressure within the package, the desired pressure being lower than the first pressure, by:

repeating at least once the two steps of:

filling the package with a gas; and reducing the pressure within the package;

in a repetition of the two steps, reducing the pressure within the package to a pressure lower than the pressure obtained in a previous iteration of the two steps; and heating the package to a first temperature during at least one iteration of the step of reducing the pressure within the package.

14. A method as is claim 13, wherein the step of heating the package includes heating the package to a temperature at which water breaks down.

15. A method as in claim 13, wherein the step of heating the package includes heating the package to at least 300 degrees Celsius.

16. A method as in claim 13, wherein the step of heating the package includes heating the package for at least one hour.

17. A method as in claim 13, wherein the step of heating the package includes heating the package sufficiently to activate a getter within the package.

18. A method as in claim 13, further comprising the step of sealing the package after the heating step.

* * * * *